United States Patent [19]

Shimozi et al.

[11] Patent Number: 4,511,536

[45] Date of Patent: Apr. 16, 1985

[54] CATALYTIC CONVERTER SECONDARY AIR SUPPLY PIPE SUPPORT

[75] Inventors: Kozi Shimozi; Hitoshi Teshima, both of Aichi, Japan

[73] Assignee: Toyota Jidosha Kabushiki Kaisha, Toyota, Japan

[21] Appl. No.: 480,814

[22] Filed: Mar. 31, 1983

[30] Foreign Application Priority Data

Jul. 24, 1982 [JP] Japan ..... 57-112677[U]

[51] Int. Cl.[3] ..... F01N 3/30

[52] U.S. Cl. ..... 422/171; 60/301; 138/113; 422/172

[58] Field of Search ..... 422/172, 171; 60/301; 138/113

[56] References Cited

U.S. PATENT DOCUMENTS 2,544,538 3/1951 Mahuken et al. ..... 138/113
3,771,969 11/1973 Scheitlin ..... 422/171
3,799,748 3/1974 Scheitlin et al. ..... 422/171
4,238,456 12/1980 Jalbing ..... 422/172
4,256,700 3/1981 Smith et al. ..... 422/172 X

FOREIGN PATENT DOCUMENTS 75526 6/1980 Japan ..... 422/172

*Primary Examiner*—Barry S. Richman
*Assistant Examiner*—William R. Johnson
*Attorney, Agent, or Firm*—Kenyon & Kenyon

[57] ABSTRACT

A catalytic converter in which at least two catalyst units are arranged within a casing in the direction of exhaust gas flow, with a space between the units transverse to the exhaust gas flow direction. A secondary air supply pipe is inserted into this space in such a manner that a base portion of the inserted pipe is sealingly secured to the casing, while the downstream end of the inserted pipe is supported by a resilient strap or leaf member, one end of which is secured to the downstream end of the inserted pipe and the other end is secured to the casing.

5 Claims, 3 Drawing Figures

CATALYTIC CONVERTER SECONDARY AIR SUPPLY PIPE SUPPORT

BACKGROUND OF THE INVENTION

1. Field of the Invention

This invention relates to catalytic converters for the exhaust systems of internal combustion engines; more particularly it relates to a catalytic converter (hereinafter referred to as a "coupled type catalytic converter") in which at least two catalyst units are arrayed in series in the direction of exhaust gas flow, with a suitable gap between the units in which is mounted a secondary air supply pipe.

2. Prior Art

A coupled type catalytic converter comprises one catalyst unit (hereinafter referred to as the first catalyst unit) disposed at the exhaust gas inlet end (upstream end) of the converter container for effecting chiefly the reduction reaction, and a separate catalyst unit (hereinafter referred to as the second catalyst unit) disposed at the exhaust gas outlet end (downstream end) of the converter container for effecting chiefly the oxidation reaction, so that all harmful components in the exhaust gas, irrespective of their nature, can be converted into cleaned or purified gases to prevent environmental pollution. Since a large amount of the oxygen in the exhaust gas is consumed in the first catalyst unit before the exhaust gas flows into the second catalyst unit, there is not enough oxygen left for the second catalyst unit to fully perform the oxidizing function. Therefore, it is accepted practice to supply secondary air from a secondary air supply pipe to the upstream portion of the second catalyst unit, to provide sufficient oxygen gas such that the second catalyst unit can fully effect the oxidation reaction.

Generally, catalytic converters such as coupled type converters are placed under very severe thermal conditions, since they carry high temperature exhaust gases. In coupled type converters, therefore, the difference in thermal expansion between the container and the secondary air supply pipe causes thermal stress and thermal fatigue, while the engine vibration causes mechanical fatigue, so that the air supply pipe may be prematurely damaged or deformed, thereby interrupting the supply of secondary air and degrading the purification performance of the coupled type catalytic converter.

SUMMARY OF THE INVENTION

It is an object of the present invention to provide a catalytic converter which is free from the drawbacks encountered in the conventional coupled type catalytic converters.

More specifically, an object of the present invention is to provide a coupled type catalytic converter which can maintain its catalytic function for a prolonged time period under conditions of actual use in a vehicle.

It is another object of the present invention to provide a coupled type of catalytic converter which enables delivery of a stable supply of secondary air to a second catalyst unit.

To accomplish the above objects, a catalytic converter according to this invention includes a secondary air supply pipe having a base portion fastened to the container by an appropriate means, such as welding, and an end portion which is inserted inside the container but is spaced from the container wall and is supported by a resilient member. The particular resilient member may be a metal strap having one end fastened to the end of the secondary air pipe, an opposite end fastened to the container, and a constricted central portion with resiliency in a direction in which the secondary air supply pipe expands and contracts.

BRIEF DESCRIPTION OF THE DRAWINGS

The above and other objects and features of this invention will be better understood from the following description of the invention read in conjunction with the attached drawings, in which.

DETAILED DESCRIPTION OF THE PREFERRED EMBODIMENT

The invention will be described below by way of a preferred example in conjunction with the drawings.

Figure 1:
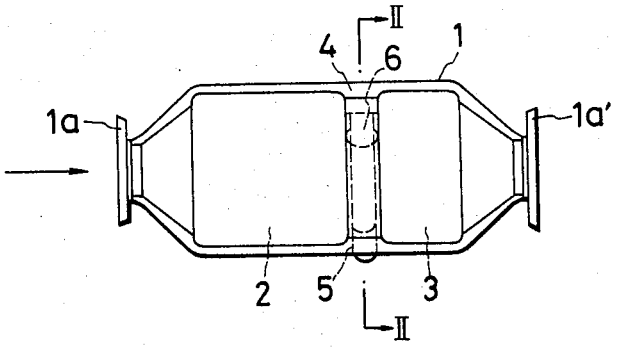
FIG. 1 is a plan view showing a catalytic converter according to an embodiment of this invention.
Figure 2:
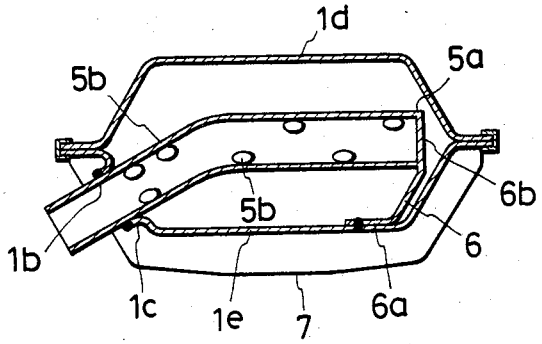
FIG. 2 is a section view taken along the line II—II of FIG. 1.

FIGS. 1 and 2 illustrate a catalytic converter, with an arrow indicating the flow direction of the exhaust gas. Reference numeral 1 denotes a converter housing having flange-shaped mounting portions 1*a*, at both ends thereof so that an exhaust pipe (not shown) can be connected thereto. The container 1 is subdivided into a first catalyst unit 2 and a second catalyst unit 3 located at the upstream end and downstream end, respectively, of the converter. As mentioned above, the first catalyst unit 2 chiefly catalyzes the reduction reaction, and the second catalyst unit 3 chiefly catalyzes the oxidation reaction. These catalyst units 2, 3 are shaped to fit the portions of the container 1 in which they are installed, with a gap 4 being left between the first catalyst unit 2 and the second catalyst unit 3. A secondary air supply pipe 5 is disposed in the gap 4 in a manner as described below in detail.

The secondary air supply pipe 5 is connected at its upstream end to an air supply means (not shown) located outside the container 1, and its downstream end 5*a* is inserted into the container 1 through an opening 1*b* formed in the container 1 at the location of the gap 4. The secondary air supply pipe 5 extends transversely to the exhaust gas flow direction generally in alignment with a central horizontal plane within the gap 4 relative to the installed position of the converter. That is, the secondary air supply pipe 5 traverses the gap 4 in the transverse direction of the converter. The end portion of the pipe 5 which is inserted into the gap 4 (referred to hereinafter as the "inserted base portion") is spaced from the walls of the container 1.

The opening 1*b* of the container 1 protrudes outwardly to form a protrusion or a so-called burring 1*c* which is designed to fit the periphery of the inserted base portion of the secondary air supply pipe 5, the pipe 5 and the container 1 being then firmly secured together by an appropriate means, such as welding.

Figure 3:
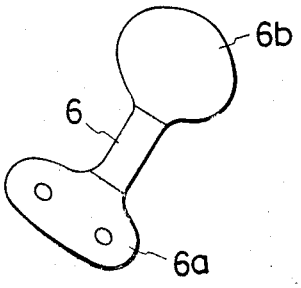
FIG. 3 is a perspective view of a resilient support member according to the preferred embodiment of this invention.

Further, the downstream end 5*a* of the inserted base portion of secondary air supply pipe 5 is supported by a resilient member 6 in the form of a strap or a leaf spring. Resilient member 6 is secured at one end onto the bottom surface of the container 1 and is integrally fastened to the pipe 5 by an appropriate means such as welding so as to close the end portion 5*a*. Resilient member 6 has a shape as shown in FIG. 3, with one end forming a first mounting portion 6*a* to be secured to the container 1 and its other end forming a second mounting portion 6*b* to be fixed onto and close the downstream end 5*a* of the secondary air supply pipe 5. The central portion of the resilient member between its ends 6*a* and 6*b* is constricted. The first mounting portion 6*a* is mounted flat along and integrally fastened to the bottom surface of the container 1, and the second mounting portion 6*b* contacts and is integrally fastened to the periphery of the downstream end 5*a*. Thus, the secondary air supply pipe 5 is firmly supported in the gap portion of the container at these two integrally fastened locations. Further, the resilient member 6 is made of an appropriate material such as stainless steel and absorbs relative displacement between the secondary air supply pipe 5 and the container 1.

The inserted end portion of pipe 5 has a plurality of nozzles (openings) 5*b* on the side where the second catalyst unit 3 is located, as is customary, so that a predetermined amount of air from the secondary air supply source is blown through the nozzles 5*b* and mixes with the reduced exhaust gases before they enter the second catalyst unit. In FIG. 2, reference numeral 7 denotes a shield which is made of, for instance, soft steel and is located under the converter to protect it against impact from below.

The method of assembling the embodiment shown in FIGS. 1–3 is conventional, and therefore a detailed explanation is omitted. Briefly, an upper member 1*d* of the container is integrally attached to a lower member 1*e* for completion of assembling, after the first and second catalyst units and the secondary air supply pipe have been installed within the lower member and the pipe has been secured to the lower member 1*e*, both at the hole 2*b* and from the downstream end 5*a* of the pipe via the resilient member 6 to the bottom of lower member 1*e*.

Alternative arrangements are also included in this invention. For example, the above described outward protrusion 1*c* may be constructed to extend inwardly into the container 1, so long as it fits the peripheral surface of the secondary air supply pipe 5 that is to be integrally supported. This construction allows firm securing, as described above.

In the above-mentioned embodiment, the resilient member 6 is integrally secured at one end 6*a* to the bottom surface of the container 1 and extends toward the downstream end 5*a* of the secondary air supply pipe 5. Alternatively, member 6 may be secured to a surface other than the bottom surface of the container 1, so long as member 6 can effectively use its resiliency to accommodate relative movement between the pipe end 5*a* and the container. For example, the resilient member may be hung from the upper member of the casing. The resilient member may be of substantially uniform thickness, or the central portion may be made thicker or thinner than the end portions, provided that the width of the central portion is constricted with respect to the end portions.

In the above-described embodiment, the container 1 consists of an upper member and a lower member, and the secondary air supply pipe 5 is installed to suit this construction by forming the opening 1*b* at a position displaced from the central horizontal interface between the upper and lower members, and the secondary air supply pipe 5 is correspondingly bent in the gap 4. The opening 1*b* may be formed, however, in the central horizontal plane of container 1, and the pipe 5 can then extend straight in the gap.

According to this invention, the inserted base portion of the secondary air supply pipe is secured at the point where it enters the container so as to be disposed in a predetermined position in the container, and the downstream end of the pipe is fastened to another portion of the container via a resilient member so that relative movement between the secondary air supply pipe and the container can be absorbed. Therefore, the secondary air supply pipe can be maintained in its initially installed position to assure that secondary air can be supplied to the second catalyst unit over extended periods of time.

Although the resilient means is shown as a strap member 6 with a constricted center portion in FIG. 3 according to the above-described embodiment, it should be understood that such a resilient means may have any form so long as it can function in the same or similar manner as member 6.

In addition to the described embodiment of the invention, it will be apparent to one of ordinary skill in the art that many changes and modifications can be made thereto without departing from the spirit and scope of the invention as set forth herein.

We claim:

1. In a catalytic converter for exhaust gases from an internal combustion engine, the converter including a casing having an exhaust gas inlet and an exhaust gas outlet disposed at opposite ends of the casing, at least two catalyst units disposed within the casing in series along the path of exhaust gas flow, the two catalyst units being separated by a space extending transversely to the path of exhaust gas flow, and a secondary air supply pipe having a downstream end portion inserted from the outside through means defining a hole provided in the casing into the transverse space, the inserted portion of said pipe having a plurality of openings for introducing secondary air into said space, wherein the improvement comprises:

the inserted portion of the secondary air supply pipe has a base portion that is sealingly secured to the casing in the vicinity of said hole provided in the casing and a downstream end located in said transverse space adjacent to, but spaced from, a portion of the casing opposite said hole, and an elongated spring means in the form of an elongated flat metal strap having a first end and a second end joined by a constricted central portion supports the downstream end of the portion of the secondary air supply pipe inserted in the casing, such that the first end of the metal strap is secured to and sealingly covers said downstream end of the secondary air supply pipe and the second end of the metal strap is secured to the casing at a location offset laterally from the downstream end of the supply pipe such that the strap will yieldably bend in response to thermal expansion and contraction of the supply pipe with respect to the casing.

2. A catalytic converter according to claim 1, wherein the metal strap is made of stainless steel.

3. A catalytic converter according to claim 1, wherein the casing comprises an upper member and a lower member which are sealingly joined together.

4. A catalytic converter according to claim 1, wherein the means defining a hole provided within the casing further comprises an annular protrusion fitting the outer periphery of the secondary air supply pipe.

5. A catalytic converter according to claim 1, wherein the catalyst units comprise a first catalyst unit which is adapted to chiefly catalyze a reduction reaction of the exhaust gases and a second catalyst unit which is adapted to chiefly catalyze an oxidation reaction of the exhaust gases, said first and second catalyst units being disposed at the exhaust gas inlet end and outlet end, respectively, of the casing.

* * * * *